US009752812B2

(12) United States Patent
Camacho Velazquez

(10) Patent No.: US 9,752,812 B2
(45) Date of Patent: Sep. 5, 2017

(54) ICE MAKING DEVICE

(71) Applicant: MABE, S.A. DE C.V., Santiago de Queretaro, Queretaro (MX)

(72) Inventor: Alan Federico Camacho Velazquez, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 179 days.

(21) Appl. No.: 14/638,271

(22) Filed: Mar. 4, 2015

(65) Prior Publication Data

US 2015/0308724 A1 Oct. 29, 2015

(30) Foreign Application Priority Data

Mar. 4, 2014 (MX) ..... MX/a/2014/002590

(51) Int. Cl.
*F25C 5/18* (2006.01)
*F25C 5/04* (2006.01)
*F25C 1/24* (2006.01)

(52) U.S. Cl.
CPC . *F25C 5/04* (2013.01); *F25C 1/24* (2013.01)

(58) Field of Classification Search
CPC ..... F25C 5/005; F25C 2400/10; F25C 1/10
USPC ..... 62/344, 345, 340
See application file for complete search history.

(56) References Cited

U.S. PATENT DOCUMENTS

2005/0160757 A1* 7/2005 Choi ..... F25C 1/10 62/344
2008/0006048 A1 1/2008 Yoon et al.
2009/0178431 A1* 7/2009 Cho ..... F25C 1/04 62/345
2009/0289537 A1* 11/2009 Cabal Velarde ... A47B 88/0055 312/408
2009/0314024 A1 12/2009 Choi
2012/0279246 A1 11/2012 Velazquez

* cited by examiner

*Primary Examiner* — Melvin Jones
(74) *Attorney, Agent, or Firm* — Terry M. Sanks, Esq.; Beusse Wolter Sanks & Maire, PLLC

(57) ABSTRACT

A device for making ice bars set within a freezer of a household refrigerator, the device comprising a carcass with a lateral face, an opposite lateral face, a neck in "V" shape, the lateral faces and a guiding throat which tops off with a semi-cylinder which is in connection with a "C" channel set over the opposite lateral face; a lever set over a runway found on the lateral face of the carcass, wherein said lever is mechanically grasped to a helicoid spring which returns it to its resting position, the lever comprising a disk and a "U" channel set over the disk and a pair of cylindrical concentric walls which form a cavity which houses the helicoid spring; a guard set over the lateral face of the carcass which contains the lever, the guard has an inner face; wherein said guard has a protruded tube in its inner face which is housed within the inner cylindrical wall of the lever; a tray which houses a series of molds for making ice bars, which on its flank sides has set on it a central axis portion and a cam follower; and a drawer for collecting the ice bars produced and extracted from the tray upon turning it and deforming it, when the user takes the lever to its final resting position on the runway.

6 Claims, 13 Drawing Sheets

ICE MAKING DEVICE

CROSS-REFERENCE TO RELATED APPLICATIONS

This application claims priority to Mexican Patent Application No. MX/a/20141002590 filed Mar. 4, 2014, and incorporated herein by reference in its entirety.

BACKGROUND OF THE INVENTION

The present invention relates to an ice making device. Said ice making device is designed to be mounted in a removable manner within a freezer compartment of a household refrigerator. More specifically, it relates to an ice making device of the kind which has a rotating ice making tray which is also extractable by means of a rotation transmission mechanism.

PRIOR ART DESCRIPTION

Ice making devices are usually mounted within a freezer compartment in a typical refrigerator with the end goal of easing the manufacture and dispensation of the same. In the state of the art, trays or molds for ice are found which can be rotated in order to empty the ice cubes formed within them by means of simple independent knobs coupled unto each of the same. Currently, the rotation systems for freeing the ice cubes have been mainly perfected as can be seen in the following documents in the state of the art.

For example, in United States application number 2008/0006048 A1 a tray assembly for manufacturing ice is disclosed which is composed mainly by an exterior carcass, an inner carcass which is slidably engageable within the exterior carcass, two ice forming trays found in the inner part of the inner carcass, a gear mechanism activated by a lever which causes the trays to turn, and a removable water tank found on the upper part of the exterior carcass. In said ensemble, the water is poured unto the trays from the container tank by means of a valve which is manually activated by means of a lever, which ends up being very impractical to the user seeing as said mechanism needs to remain in a constantly activated manner while the filling of said trays is being carried out. Additionally, there is a hopper and duct system to guide the water towards the trays, causing said ensemble to be considerably more complex and therefore more expensive. Similarly, said valve element does not have a system for avoiding that any water residue remains stagnant and which may accumulate near the same, which, even though it could be minimal, can actually become frozen creating a bad seal in the same and therefore an improper function of the assembly. Lastly, the trays are found assembled in a permanent manner within the inner carcass, and therefore, they cannot be separated from the same, thus considerably increasing the difficulty in their maintenance and/or cleansing.

Furthermore, United States publication number US 2009/0314024 A1 discloses an apparatus for the manufacture of ice which comprises a carcass with an ice formation chamber, two trays set for their rotation within the inner part of the ice formation chamber, a tray impulse mechanism formed by a series of gears and an activating lever, a water tank set apart from the carcass and placed in a fixed and isolated manner on the door of the freezer. In said apparatus, the water is poured unto the trays from the fixed tank by means of a valve activated by an electrically driven lever and through a system of hoppers and ducts in order to guide the water unto the trays, causing said ensemble to be considerably more complex and thus more expensive. This apparatus is particularly focused towards solving the problem of the vortex or whirlpool phenomenon formed in the water within the ducts guiding onto the trays, so that fins or guiding protuberances are found along the length of said ducts to avoid the water from running in a circumferential manner within the same. Therefore, said apparatus also does not have, within its water supply system, any feature for avoiding any water residue accumulating near the valve, which could actually become frozen creating a bad seal in the same and therefore an improper functioning of the assembly. Lastly, the trays are found assembled in a permanent manner within the inner carcass, and therefore, they cannot be separated from the same, thus considerably increasing the difficulty in their maintenance and/or cleansing.

In United States publication number US 2009/0178431 A1 an ice manufacturing unit is disclosed which comprises an ice forming carcass, a plurality of trays set for their rotation within the inner part of the ice forming carcass, a device for separating the ice from the trays by means of rotating the same and formed by a series of gears and an activating lever, a removable water supply tank set above the trays to store the water which will be supplied to the same, and an ice storage container underneath said trays. In said unit, the water is poured unto the trays from the removable tank (previously filled) by means of a valve which is automatically activated by a protuberance which is set on the carcass, once the tank is placed entirely in its place within said carcass, and through a hopper and duct system to guide the water towards the trays, causing said ensemble to be considerably more complex and therefore more expensive. Specifically, said apparatus, similarly does not have in its water supply system from the tank towards the trays, any feature for avoiding that any water residue may accumulate particularly near the valve or the exit openings of the tank, where, said residues can actually become frozen creating a bad seal in the same and therefore an improper function of the apparatus. In addition to the above, even though in this case, the trays are found assembled in a separable manner within the carcass, these are assembled once again in the same manner as that in which they were removed, given that the turn axis formed at the ends of said trays are not symmetrical, which calls for additional care on the part of the user.

United States publication number 2012/0279246 by Camacho Velazquez, describes an ice making device comprising an upper tank with a valve, a twist tray for conventional ice cubes which is coupled unto a gear mechanism which in turn is activated by a lever, wherein the carcass comprises a hinged door, which once opened exposes a twist tray. Said invention is focused towards providing a filling system within the carcass, which avoids spillages, given that upon extracting and introducing the twist tray, liquid spills can occur; but the fact that there are users who appreciate removing the trays from the devices in order to make ice cubes, given that upon removing them in order to fill them, the users take advantage of this in order to clean them, which makes the user feel that the ice cubes are "clean", and this is among other reasons as to why present invention does not have an upper filling tank.

Therefore, according to the above, the need exists for having an ice making device which resolves the problems presented by the above described prior art in an effective and reliable manner.

BRIEF DESCRIPTION OF THE INVENTION

Present invention has been undertaken with the end goal of providing an efficient solution to the previously cited problems in the state of the art.

One aspect of the present invention is to provide an ice making device with a removable tray or mold which can be easily mounted and in a separable manner from the inner cover or liner of a freezer compartment of a household refrigerator.

Another aspect of the present invention is to provide an ice making device with a removable tray, which allows for manual filling of the removable tray outside the freezer compartment in a practical manner to later place it once again within the device with much ease.

Another aspect of the present invention is to provide an ice making device with a removable tray, which comprises a turn transmission mechanism for rotating the ice cube making trays, wherein said mechanism is easily operated, of simple construction and which can work efficiently to undertake the separation of the ice cubes from the removable tray.

A further aspect of the present invention is to provide an ice making device with a removable tray, in which the ice cube making tray can be separated from the main carcass to facilitate its cleansing and maintenance; and where additionally said tray has set on both sides of the same, in a symmetrical fashion, with a central rotation axis portion and an off-centered cam follower element, thereby allowing said tray the ability to be coupled back indistinctively onto the carcass.

Another additional aspect of the present invention is that of providing an ice making device with a removable tray, where the shape of the ice cubes obtained are longer than they are wider, with such luck that they form bars rather than cubes, wherein said ice bars may be easily extractable from the tray and once these are collected, they may be effortlessly introduced into the bottles or jars for water, soft drinks or soda, which have a screw top on them.

Specifically, the present invention relates to an ice making device which is designed so as to be mounted in a separable manner from the inner face or "liner" within a freezer compartment of a household refrigerator. More specifically, it relates to an ice making device of the type having a removable ice tray for containing water for later forming ice bars. Said ice making device mainly comprises: a main carcass structure preferably with a substantially parallelepiped shape, an ice bar making tray set in a removable manner within said carcass structure; a container drawer for ice bars coupled in a slideable manner unto the lower part of the carcass structure; a turning transmission mechanism which allows turning said ice making tray a predetermined angle and wherein said turning transmission mechanism is created by a manually driven lever coupled in a pivotable manner by means of one of its ends to the carcass structure, tied by means of a spring to the carcass where said spring itself in turn, grants the necessary torque par in order to return it to its resting position once the external force exerted by the user on the lever has ceased.

Other aspects and advantages of the present invention will become apparent when referenced with the specification taken into account together with the following figures.

BRIEF DESCRIPTION OF THE FIGURES

The particular features and advantages of the invention, as well as other aspect of the invention will become apparent from the following description, taken together with the accompanying figures, in which.

DETAILED DESCRIPTION OF THE INVENTION

Figure 1:
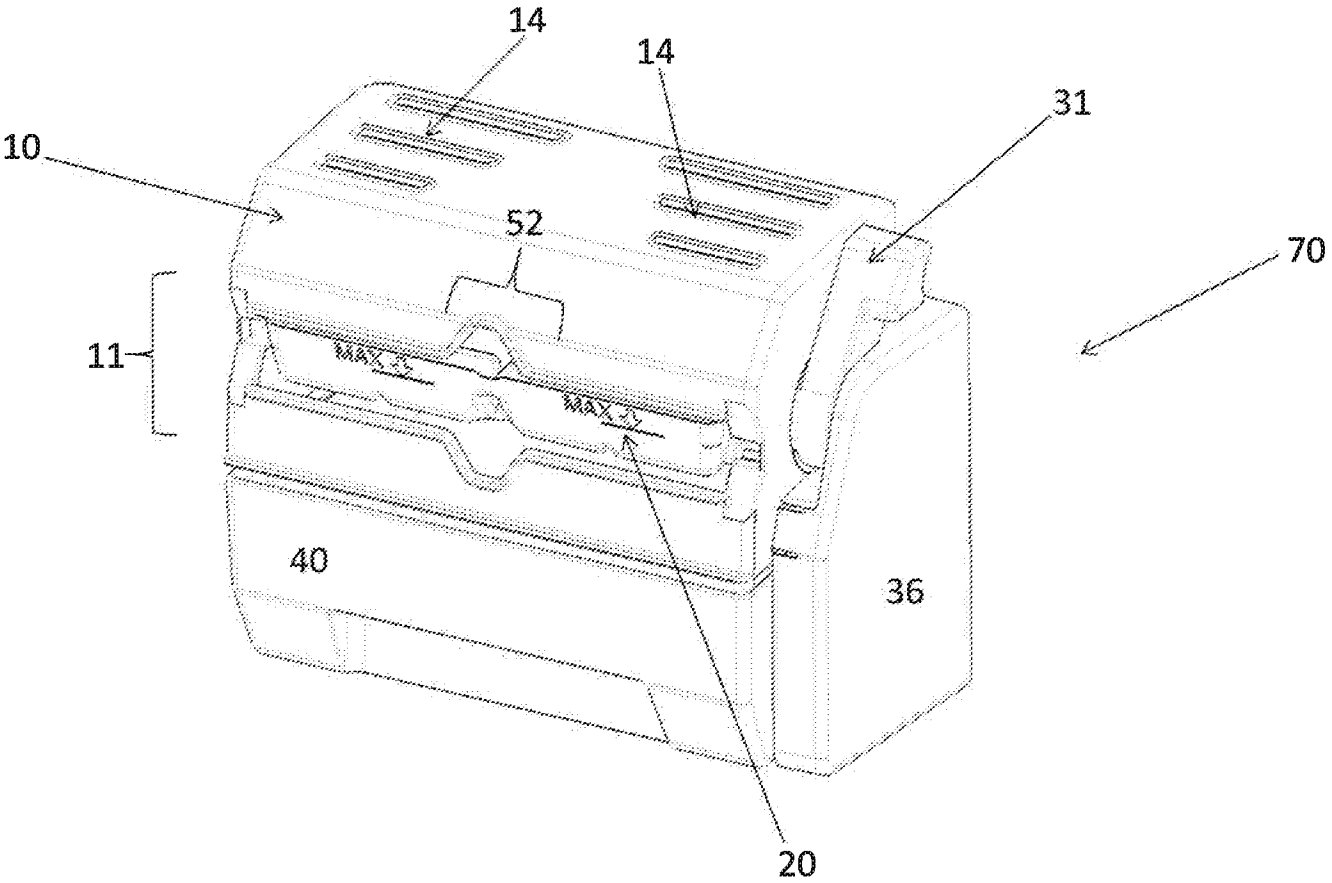
FIG. 1 is a conventional perspective view of the ice bar making device.
Figure 2:
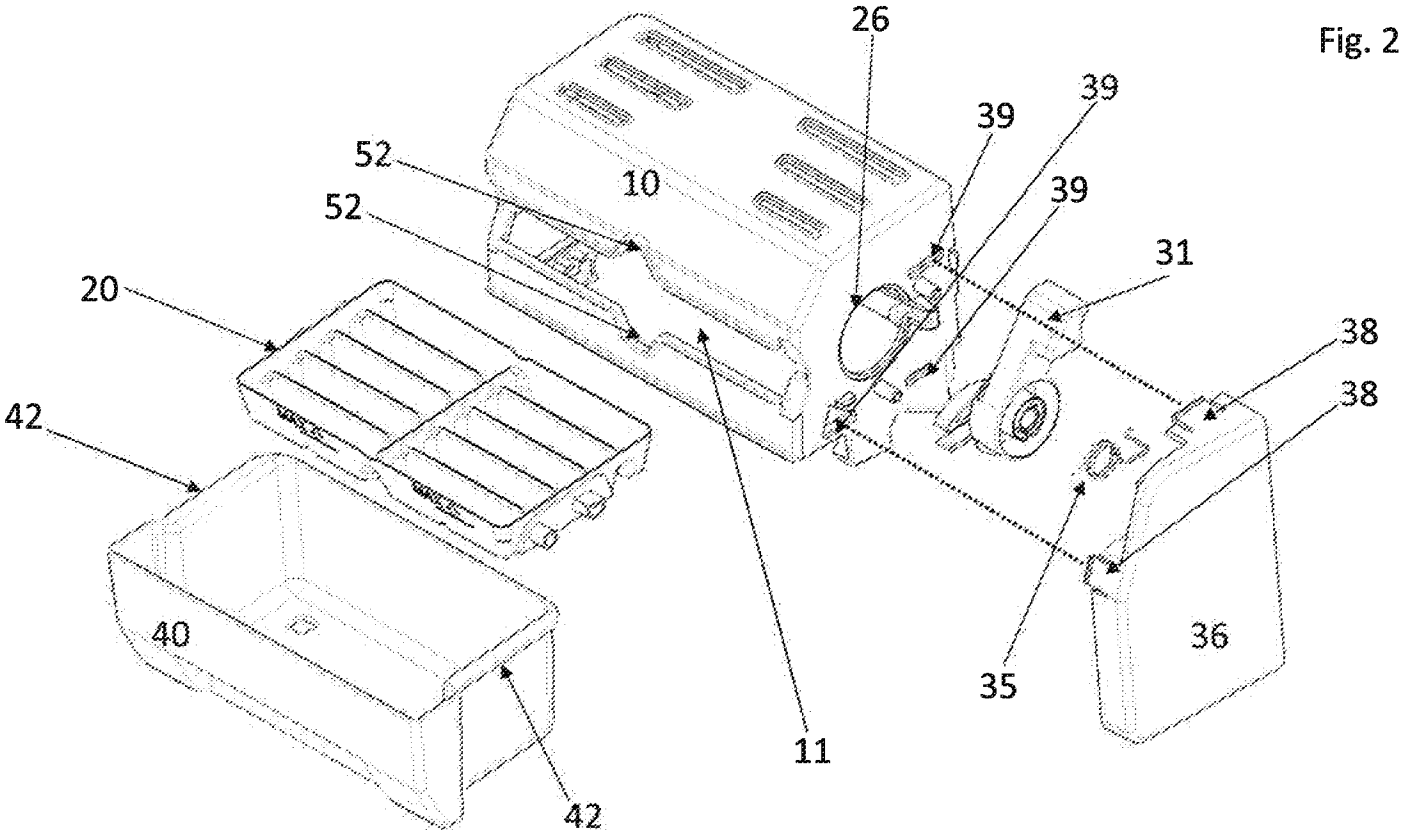
FIG. 2 is an exploded view of the ice bar making device.
Figure 3:
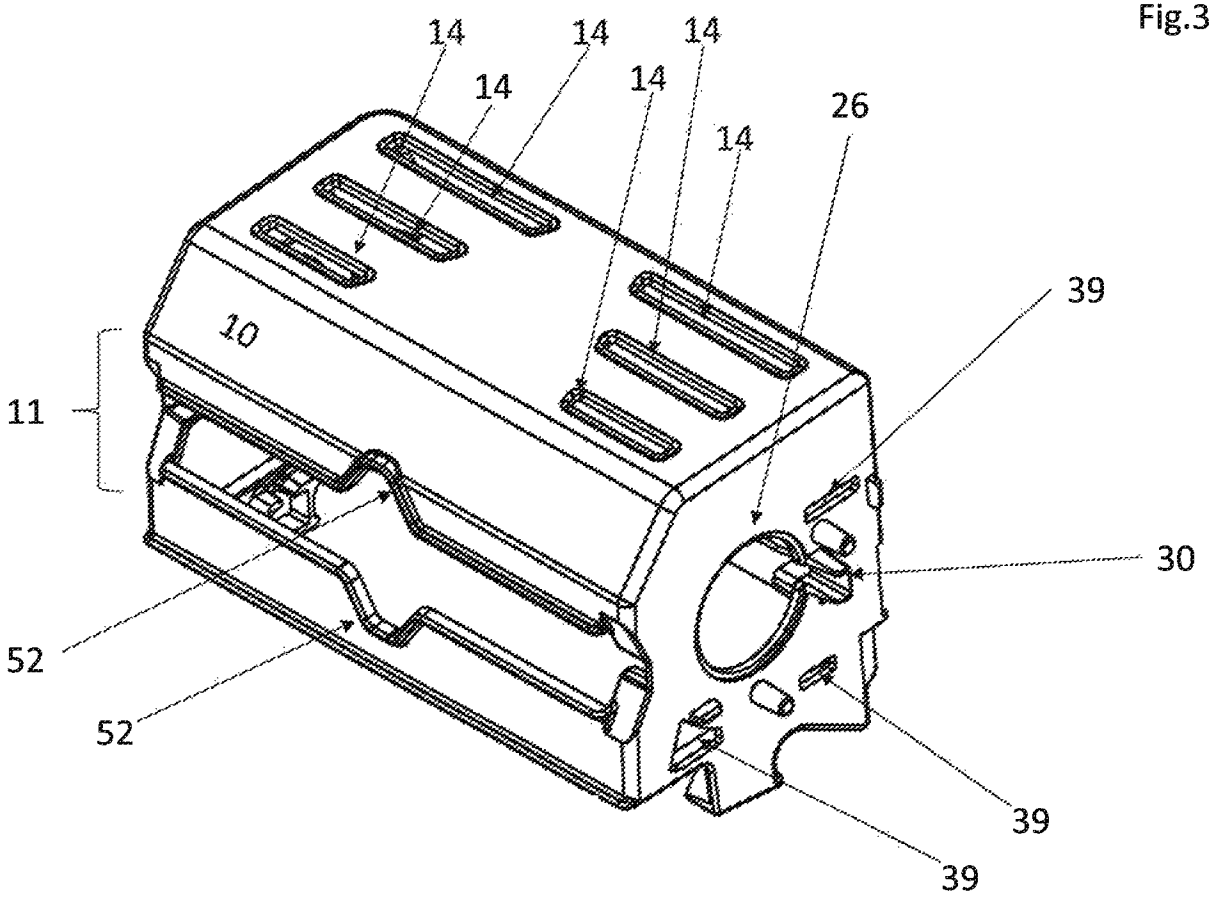
FIG. 3 is a conventional perspective view of the carcass.

The present invention relates to an ice making device which is designed to be mounted in a separable manner on the inner cover or "liner" (46) of a freezer compartment of a household refrigerator. More specifically, it relates to an ice making device of the type having a removable ice tray for containing water in order to form ice bars.

As is shown in FIGS. 1 through 12*b* the ice bar making device (70) is constituted by a series of main elements coupled between them and which interact effectively in order to carry out the function of the same, such as explained below.

Initially it has a main carcass structure (10) (illustrated in FIG. 3) which in a preferable manner has a substantially parallelepiped shape, and which functions as the main structure for support for the entire ice bar making device (70). Said main carcass structure (10) may be manufactured with any adequate rigid polymeric material, such as polycarbonate, polyethylene, polystyrene, etc. Additionally, in its front part it has an opening, a groove or a window (11) in order to enable easy introduction or removal of the ice bar making tray (20) into the inner part of the carcass (10); the referred to window (11) runs along the length of the front face of the carcass (10), has a height somewhat greater than the height of the tray (20), which allows for effortless introduction of this latter one into the inner part of the carcass (10). Similarly, from FIGS. 1, 2, 3, 7*a*, 7*b* which make known that in its middle part, a widening, resembling lips is found, from here on after referred to as lips (52), these allow the user to introduce fingers through these lips in order to grasp the tray (20) in a clasping manner: which to a great extent eases the introduction or extraction of the tray (20) from the carcass (10).

As can be seen in a better way in FIGS. 1, 2, 7*a*, 7*b*, 8; a lateral cover for the carcass (36) is coupled unto a flank side of the carcass structure (10) in a guard manner, wherein said guard (36) is set with an axis (37) in tube shape over which the lever (31) turns, it also keeps the spring (35) which is housed within the body of the lever (31) covered. The referred to guard (36) is coupled unto a flank side of the carcass (10) by means of some resilient fingers (38) which are introduced into the windows (39), using the "snap-fit" technique, wherein the end of the resilient fingers (38) has a shaft head, which upon being introduced into the window (39) deforms the body of the resilient finger (38) recovering its shape once said head has penetrated the window (39) in its entirety. It also has a hole whose exposed face is designated from here on as a runway (26), which supports and houses with a set adjustment, the disk (28); adjacent to the path (26), a notch (30) is set, which allows for the free pass of the hook (25) set over the disk (28) of the lever (31). In a preferred embodiment, the carcass (10) may have on its upper part, with at least one groove (14) which allows for air circulation within the carcass (10) and therefore the ice bar making tray (20) is submerged or surrounded by cold air; similarly, different openings (14) may be undertaken in a convenient manner on different sections of the carcass (10).

Figure 4:
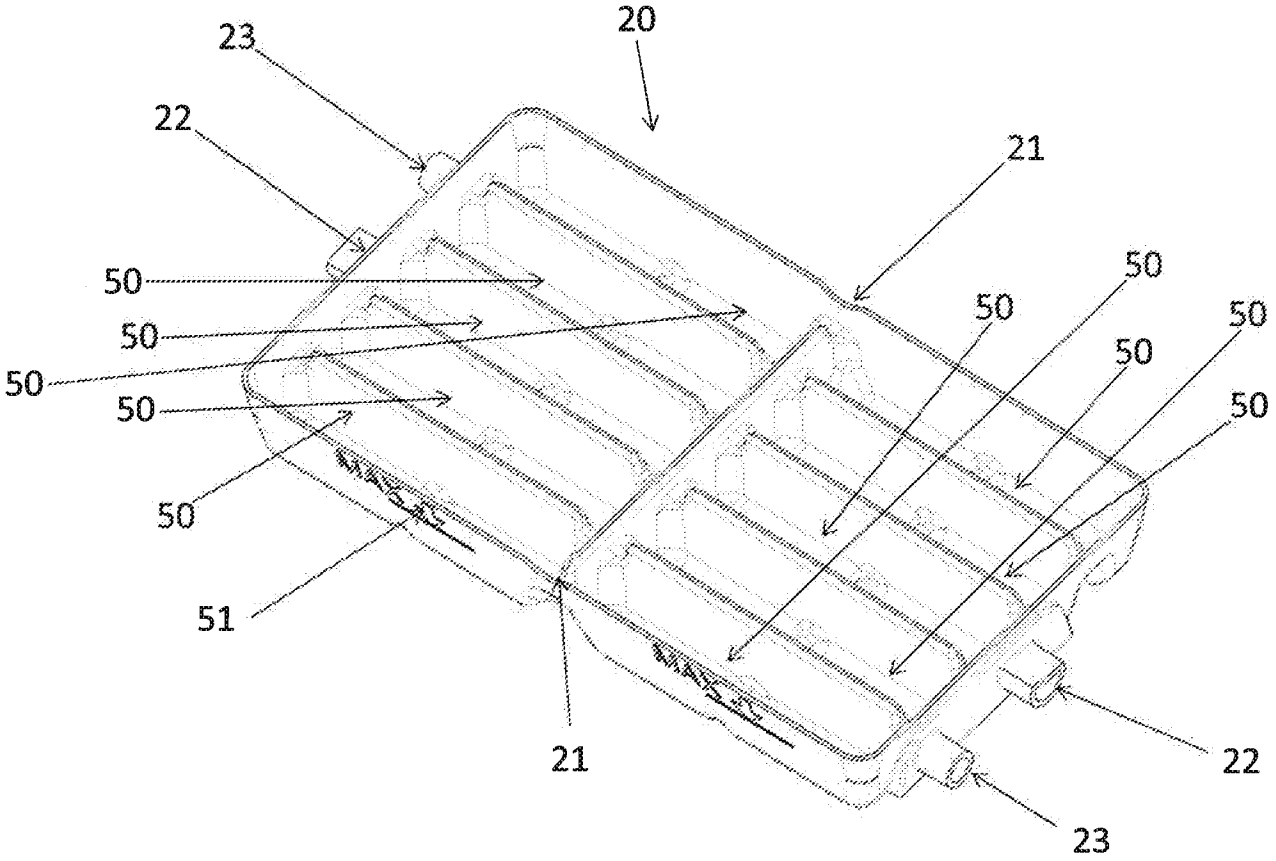
FIG. 4 is an upper perspective view of the tray.

FIG. 4 illustrates an ice bar making tray (20) which is set in a removable manner within said carcass structure (10) (see FIGS. 1, 7*a*, 7*b*, 8, 9*a*, 9*b*, 9*c*, 10*a*, 10*b*, 10*c*) in such a way that it can be turned in a determined angle preferably between 95° to 160° degrees in order to allow the freeing of ice bars from the same. Said tray (20) is preferably manufactured from an adequate semi-rigid polymeric material which will allow for additional torque of the same with an angle preferably between 10° to 30° degrees in order to further enable the detaching of the ice bars there formed; additionally it has at least one spout (21) which is placed somewhere along its upper periphery to avoid its overfilling, in addition to, the referred to spout (21) also has the function of allowing for easy introduction of the index finger through the space provided between the lips (52) specifically the upper lip and the upper part of the front wall of the tray (20), which allows for the index finger and the thumb finger to grasp the tray (20) in a clasping manner through the hole formed by the lips (52); the referred to tray (20) houses a series of molds (50) which are longer than they are wider, which allows for the formation of bars rather than cubes, this is of particular relevance, in light of the fact that cubes cannot be easily introduced into the bottles or jars which contain liquids having a screw top, knowing that these latter ones are set with an inner diameter in their necks measuring around 2 cm; thus upon forming ice bars rather than ice cubes, the bars are easily introduced into the bottles or jars with screw tops. Similarly, as was illustrated in FIG. 4, the ice bar making tray (20) has, symmetrically protruded in an integral manner on each one of its ends, a central rotational axis portion (22) and an off-centered cam follower element (23), by means of which one lateral part of the carcass (10) is assembled and through the other one of its ends to a turn or lever transmission mechanism (31).

Figure 5:
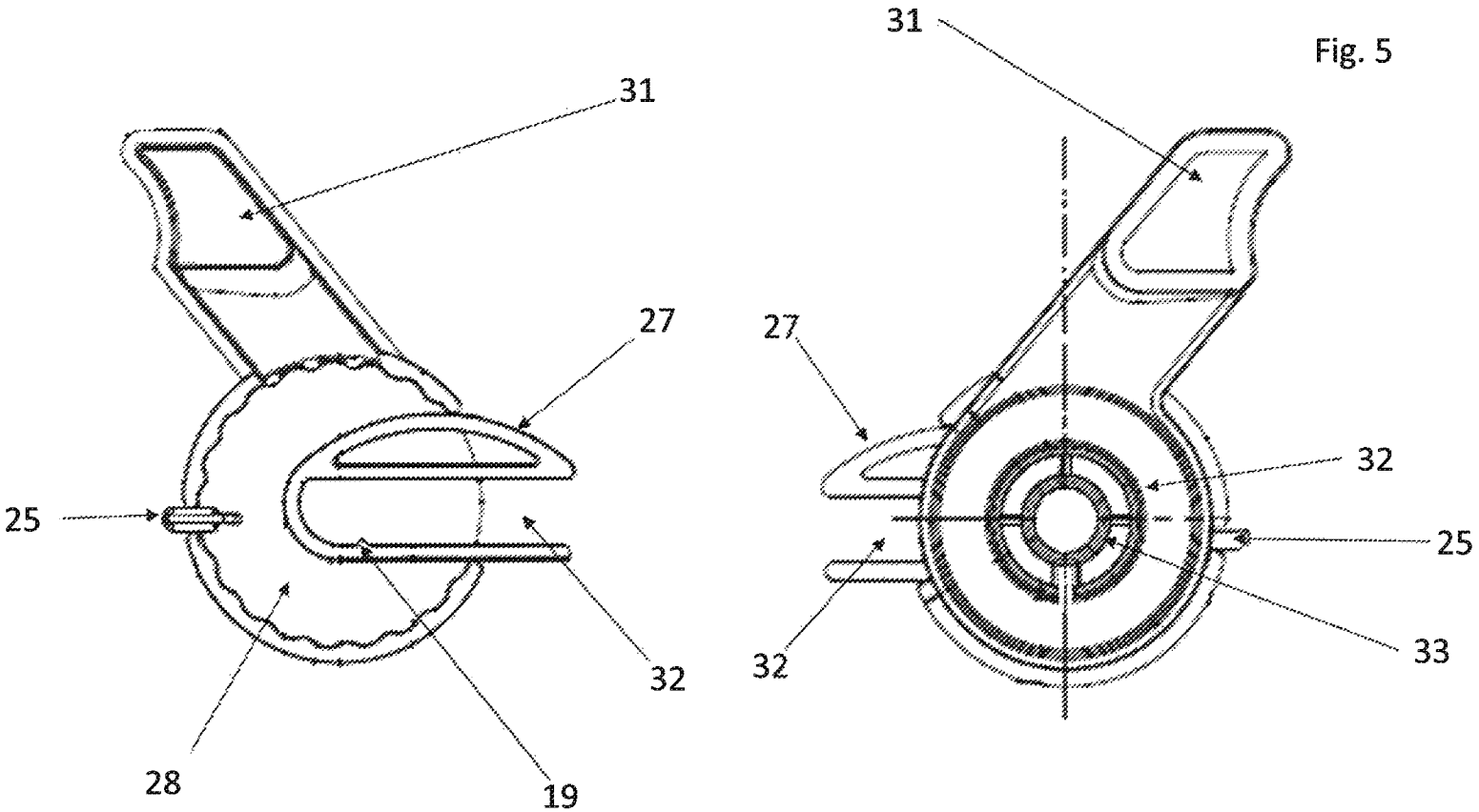
FIG. 5 shows the obverse and the reverse of the lever.
Figure 6:
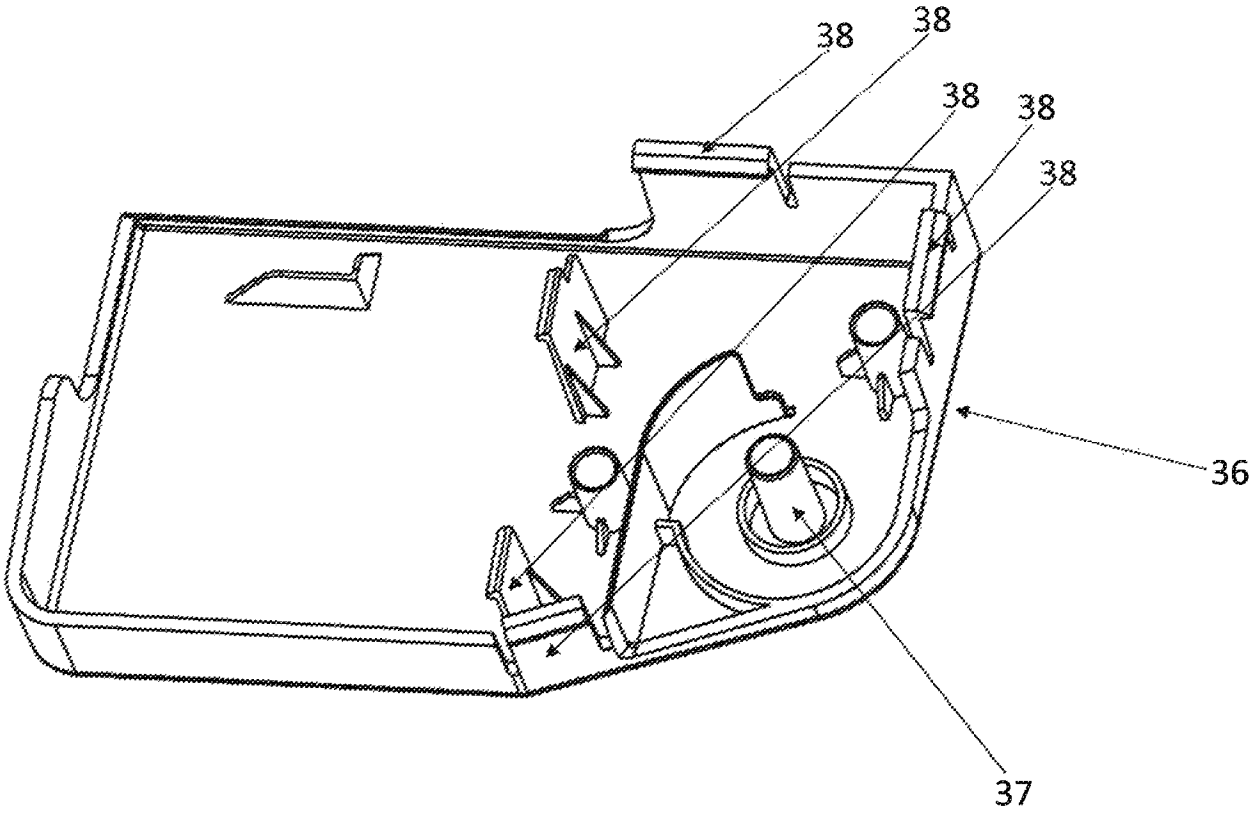
FIG. 6 is an inner perspective view of the guard.
Figure 7B:
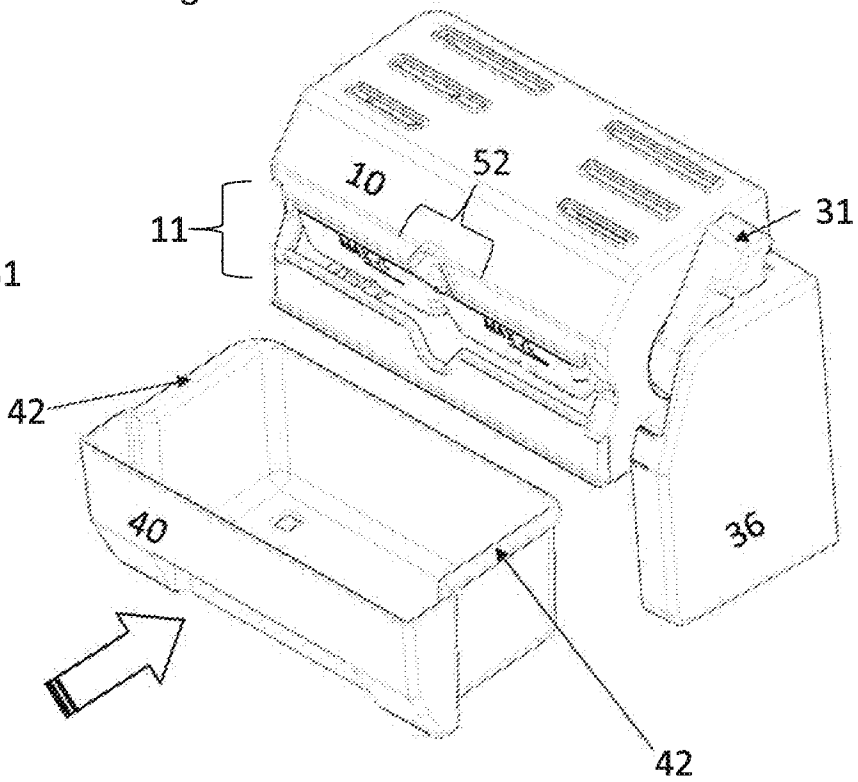
FIG. 7*b* is a conventional perspective view of the ice bar making device with the drawer in an extracted position.
Figure 7A:
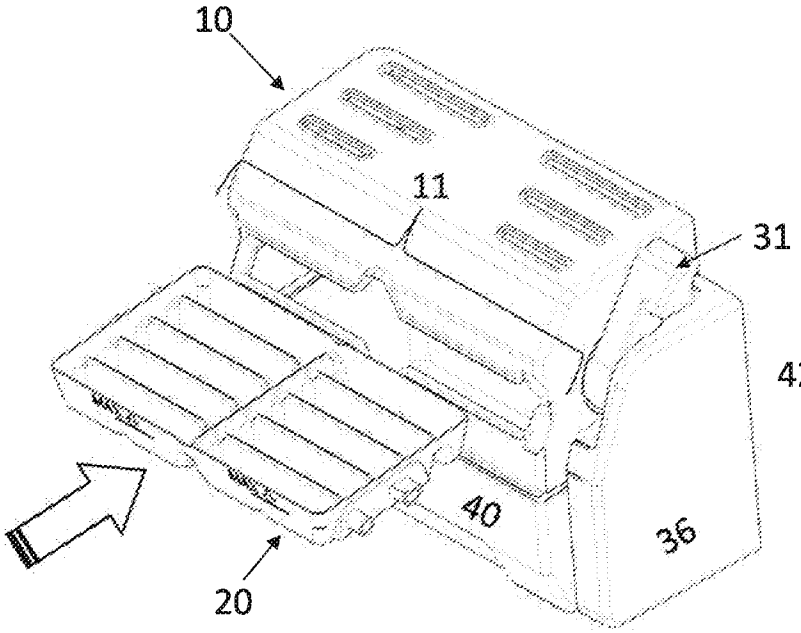
FIG. 7*a* is a conventional perspective view of the ice bar making device with the tray in an extracted position.

FIG. 5 helps us to appreciate the lever (31) which is formed by a bar which extends radially towards the outside from a center, on one side there are a pair of concentric cylindrical walls, an inner one (33) and the remaining one being an outer one (32), on the obverse side we find a disc (28) which is assembled with a set adjustment unto the path (26) so that this may be able to turn with ease with the minimum axial pitch, said disk in a preferred embodiment is set on its periphery with a series of undulations, petals or valleys and crests, which allows reducing the friction of the face of the referred to disk (28) when it comes into contact with the path (26) of the lateral face of the carcass (10). Over the periphery of the referred to disk (28) a hook (25) is also found, which helps adequately place the lever (31) over the lateral face of the carcass (10), knowing that said hook has to go through the notch (30) in order for the disk (28) to be housed within the path (26), in addition to, once the disk (28) having been inserted into the path (26) and upon applying force unto the lever (31) the disk (28) will tend to rotate within the path (26), to this the hook (25) will distance itself from its resting position and thus from the notch (30), and therefore the hook (25) will prevent the extraction or axial pitch, seeing that the referred to hook will then be in close proximity to the inner lateral face of the carcass (10) in close proximity to the periphery of the hole which grants the path (26) its shape. Similarly, over the disk (28) we find the "U" shaped channel (34), which has a hump (19) which fastens in a removable manner the central axis portion (22) of the tray (20) at a determined position. Said "U" shaped channel (34) additionally has a bulge (27), found over the upper wall of the "U" shaped channel (34), which follows the geometry of a curved or circumferential section.

Figure 9B:
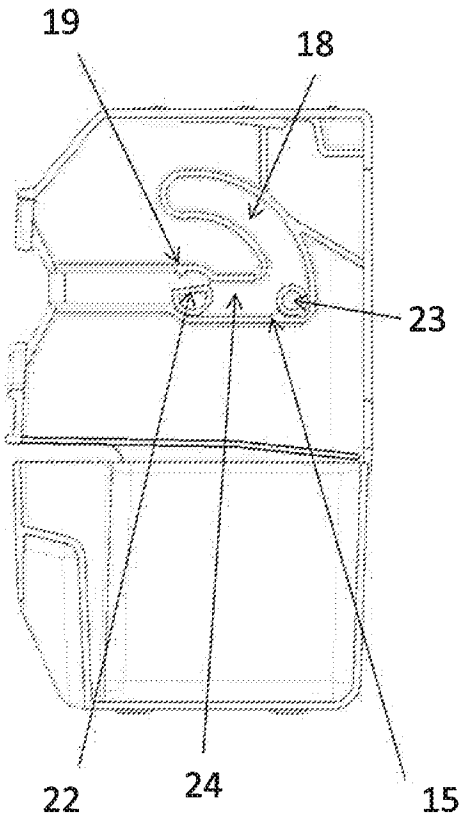
FIG. 9*b* is a lateral view of the ice bar making device illustrating the portion of the central axis and the cam follower in its resting position within the C channel.
Figure 9A:
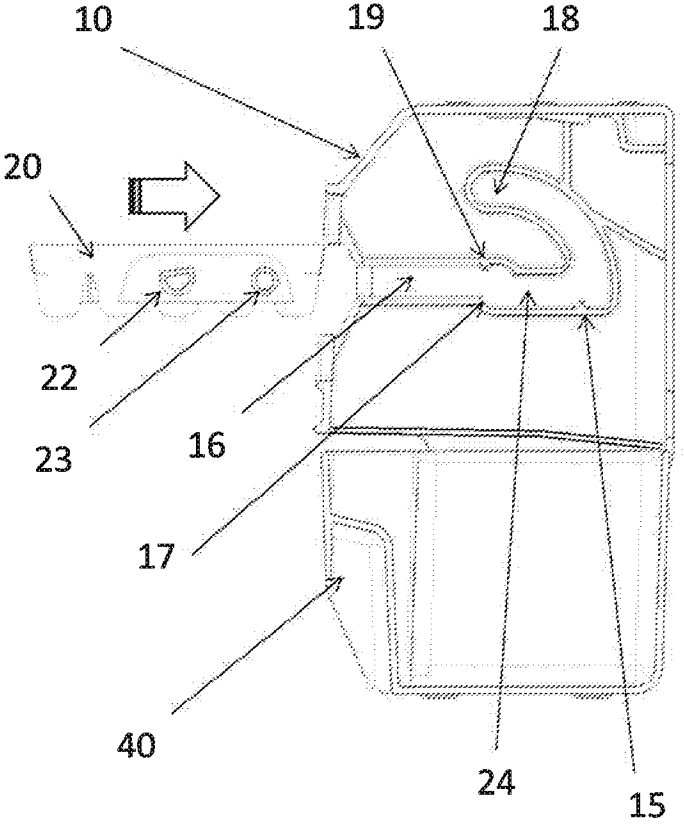
FIG. 9*a* is a lateral view of the ice bar making device with the tray in an extracted position.
Figure 9C:
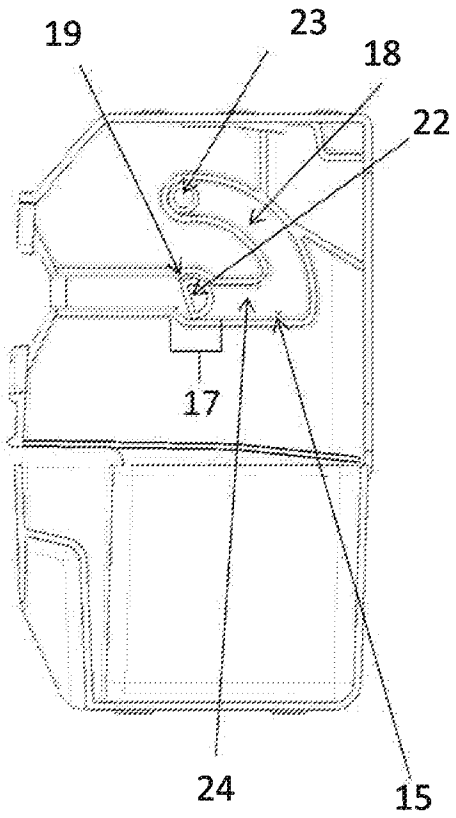
FIG. 9*c* is a lateral view of the ice bar making device illustrating the portion of the central axis and the cam follower in its end of run position within the C channel.

As can be seen particularly in FIGS. 9*a*, 9*b* and 9*c*; the assembly of the end part of the tray (20) on the lateral part of the carcass (10) takes place upon inserting in the guiding throat (16) formed in said lateral part of the carcass, both in the central axis portion (22) as well as the off-centered cam follower (23), in such a way that the central axis portion (22) runs along the length of the guiding throat (16) where it is retained in a separable manner within a semi-cylinder (17) which has a hump with a central safety latch (19) which retains in a separable manner the portion of the central axis (22) within the semi cylinder (17) for its turning; while the off-centered cam follower (23) runs on its part the horizontal length of the channel in "C" shape (24) jumping over the hump safety latch (15) to remain in its resting position, with such fate that when the tray (20) is turned, this runs a second guiding channel in "C" shape (18) which is formed on the lateral part of the carcass (10) which has a semicircular trajectory which serves to guide and halt the turn of the tray (20) at the predetermined angle. It should be highlighted that the tray (20) is formed symmetrically with the view that independently of which side it is coupled unto of the carcass (10), it may function without any problems.

Figure 10A:
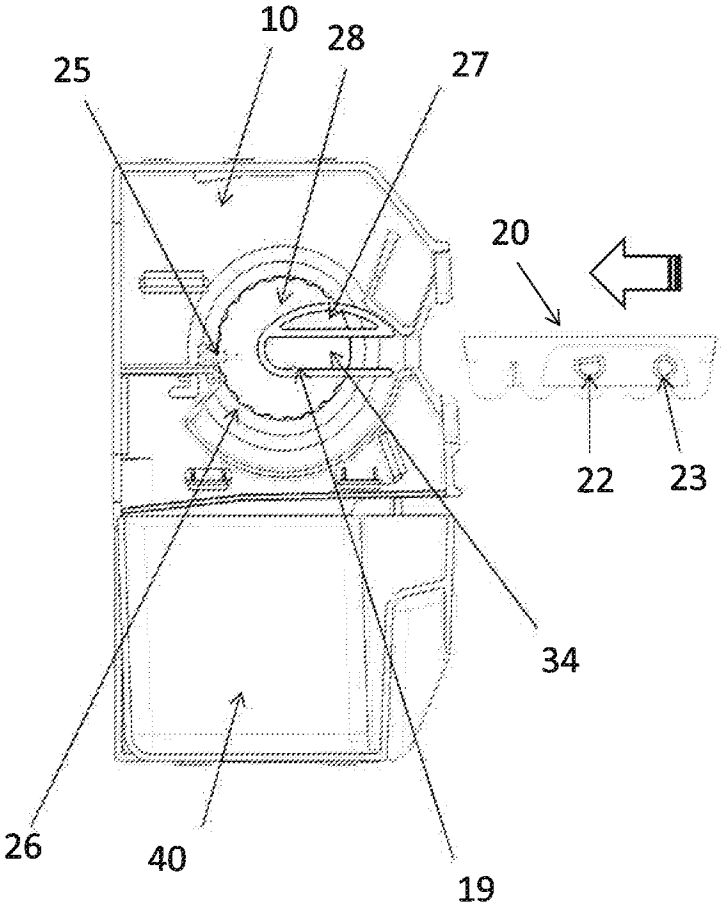
FIG. 10*a* is a lateral view of the ice bar making device with the tray in an extracted position.
Figure 10B:
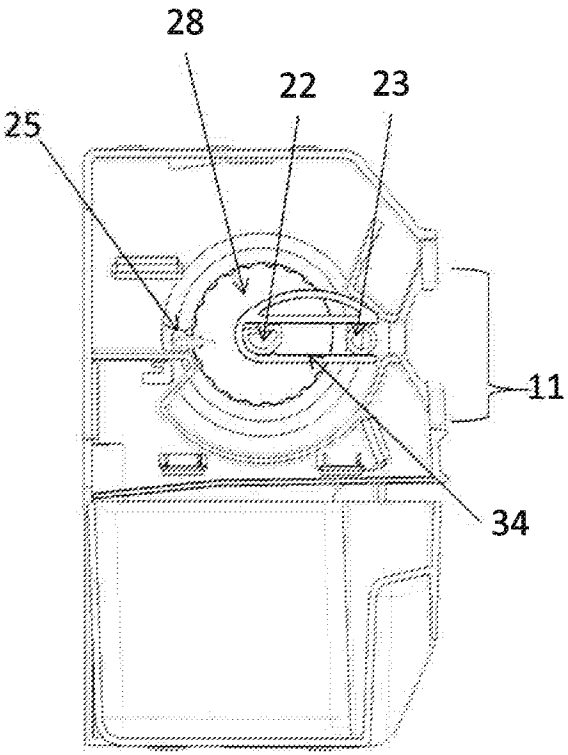
FIG. 10*b* is a lateral view of the ice bar making device illustrating the portion of the central axis and the cam follower in its resting position within the "U" shaped channel.
Figure 10C:
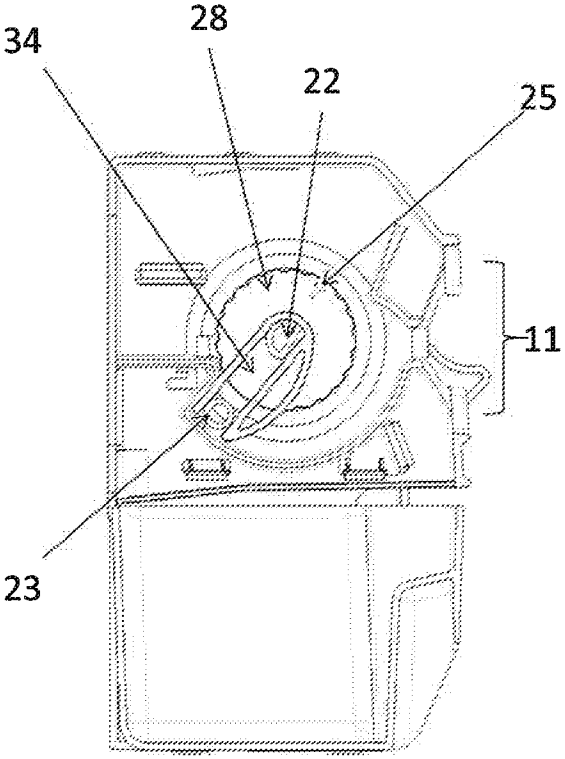
FIG. 10*c* is a lateral view of the ice bar making device illustrating the portion of the central axis and the cam follower in its end of run position within the U" shaped channel.
Figure 11:
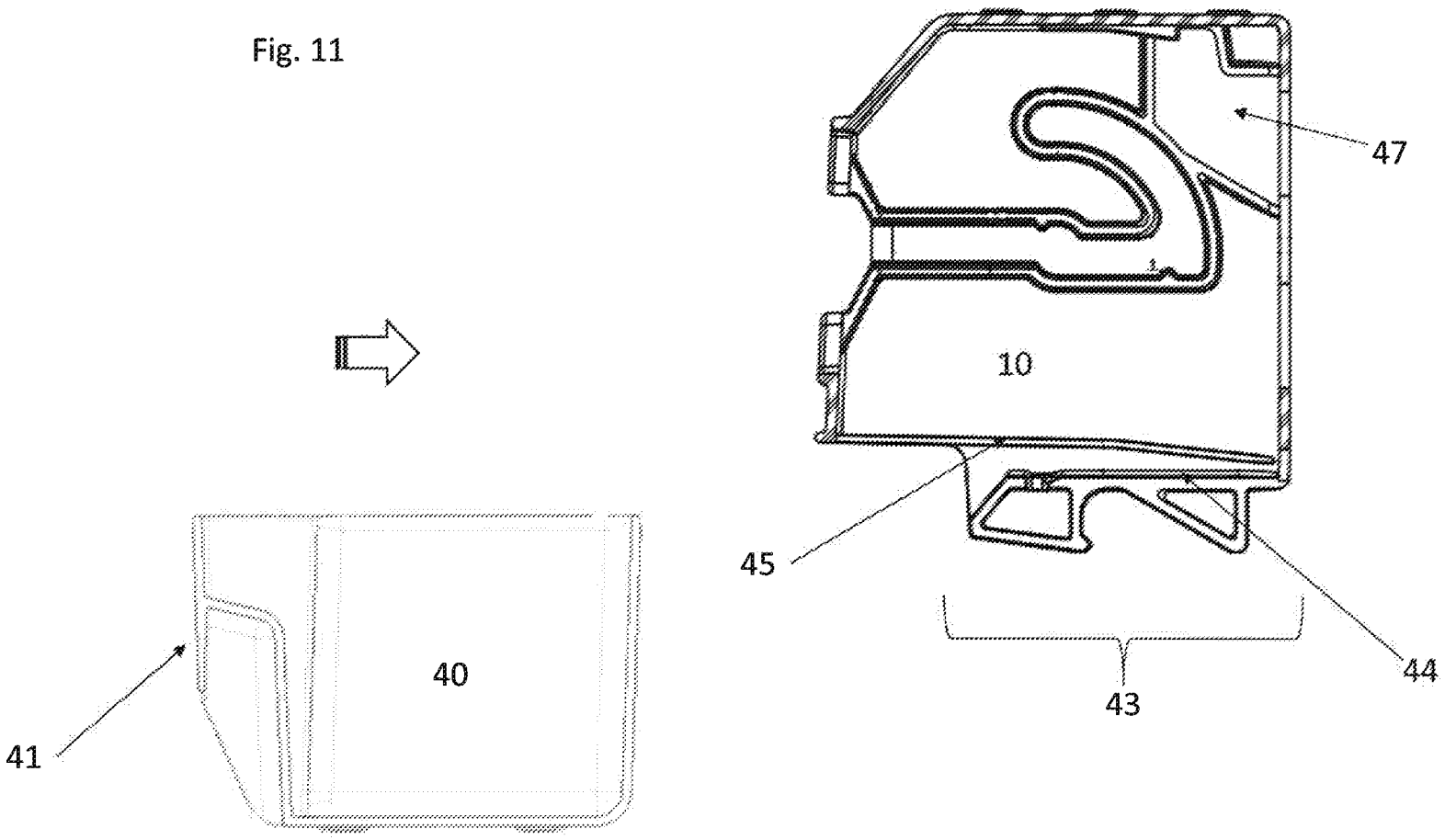
FIG. 11 is a lateral view of the carcass with the drawer in an extracted position, where the neck in "V" can be appreciated.

Now then, as is shown in detail in FIGS. 10*a*, 10*b*, 10*c*; the end of the tray (20) which is assembled unto the lever (31) is done so by means of the insertion of both the central axis portion (22) as well as the off-center cam follower element (23) of that end of the tray (20), within the "U" shaped channel (34) formed over the face of the disk (28) of the referred to lever (31); where the referred to disk (28) is found inserted in a rotatable manner within a hole set over the lateral wall of the carcass (10); the exposed face of the referred to hole forms the path (26) on which the disk (28)

rotates, thereby coupled to the lever (31) in a turning manner on the other lateral part of the carcass (10). The referred to channel in "U" shape (34) formed over the disk (28) has on its closed end, just before the curvature which the "U" closes of a safety latch hump of the central axis (19), which helps retain in an extractable manner the central axis portion (22) now housed within the "U" shaped channel (34), now then, it should be highlighted that the upper wall of the "U" shaped channel (34) has a curved wall which follows the shape of a circumference segment or of some other curve from here on called a bulge (27); the referred to bulge (27) lends a reinforcement to the upper wall of the "U" shaped channel (34) reducing the efforts present on said wall upon rotating the lever (31) and deforming the tray (20) given the torque of this.

Figure 8:
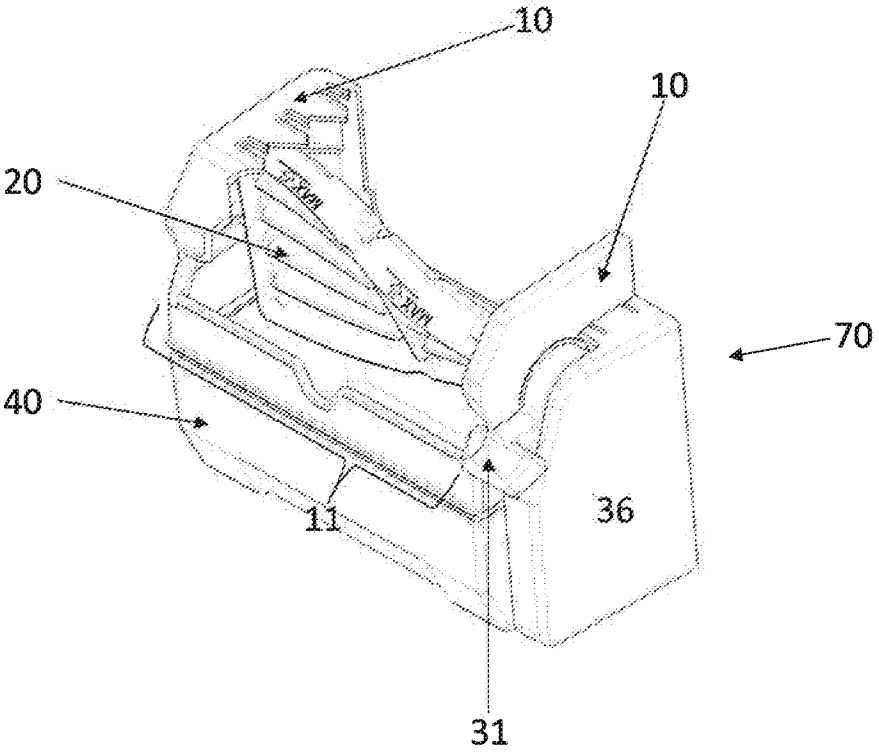
FIG. 8 is a perspective view of an upper cross cut which allows viewing the deformed tray for the extraction of ice when the lever is found at the end of its run.

Said lever (31) allows the user to rotate the ice making tray (20) for a predetermined angle (and if necessary apply an additional torque turn to the same), in this manner using the detachment of the ice bars formed there and such as is illustrated in FIG. 8; and on the other hand it allows for the coupling of said ice bar making tray (20) by means of the "U" shaped channel (34) formed especially on its back part, such as has been described above; the lever (31) also has a torque spring (35) which itself exerts a push counterforce to return the lever (31) to its resting position; said torque spring (35) is found coupled as well as housed within a circular cavity formed by a pair of cylindrical concentric walls which protrude over the outer face of the lever (31) (see FIGS. 2, 5, 7); the spring (35) has a helicoid part which is housed within the cavity formed by the outer cylindrical wall (32) and the inner cylindrical wall (33) with such luck that the inner cylindrical wall (33) remains housed within the helicoid part of the spring (35), so that one end of the spring (35) remains free which is set within a groove created for such purpose over the inner cylindrical wall (33); the remaining free end of the spring (35) gets stuck within a window set for such purpose over the lateral wall of the carcass (10). To prevent the spring (35) given the torque force it receives upon manipulating the lever (31) comes out of its position within the cavity formed by the cylindrical walls (32), (33) a guard (36) is placed over the lateral face of the carcass (10) covering the lower part of the lever (31) with such luck that the tube (37) remains housed within the inner circular wall (33), imprisoning the spring (35) within the cavity formed by the cylindrical walls (32), (33) as well as the inner face of the guard (36); the referred to guard (36) remains fixed or attached to the lateral face of the carcass (10) by means of resilient fingers (38) or snaps strategically set over the inner face of the guard (36), said fingers (38) are received in windows or grooves (39) which are set for such a purpose on the lateral face of the carcass (10).

On the other hand an ice bar container drawer (40) is coupled in slideable as well as separate manner to the lower part of the carcass structure (10). As we can see from FIGS. 2, 7*b*, 11; said drawer (40) is especially conceived to directly receive and store the ice bars formed in the ice bar making tray (20) once they are detached from the same upon being turned through means of the lever (31) A drawer (40) has a handle (41) to facilitate its extraction, and it also has a pair of fins (42) set on the upper part of the vertical lateral walls wherein said fins (42) are formed in a horizontal fashion with a thickness and width which is preferably constant. Said fins (42) run along almost the entire length of the vertical lateral wall of the drawer (40), with such luck that when the latter is introduced into the lower part of the carcass (10), inserting the fins (42) in between the neck in "V" shape (43) which is formed on its lower part by a rail (44), whose upper face comes into contact and supports the lower face of the fin (42); now then, the upper part of the "V" neck (43) is formed by a shoulder (45) which is protruded over the lower and inner part of the lateral faces of the carcass (10), opening an angle between 5° to 35°, which allows reclining the drawer (40) a small amount upon being extracted or introduced into the carcass (10). It also allows that upon introducing the drawer (40) completely, the lower part of the fins (42) remains imprisoned in a clasp like manner by the rail (44) and by the shoulder (45).

Figure 12B:
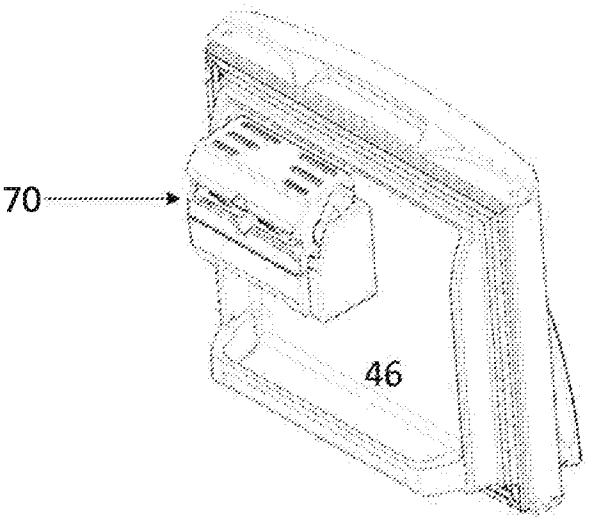
FIG. 12*b* is a conventional perspective view of the door of the freezer with a "liner" with the ice bar making device assembled over the "liner".
Figure 12A:
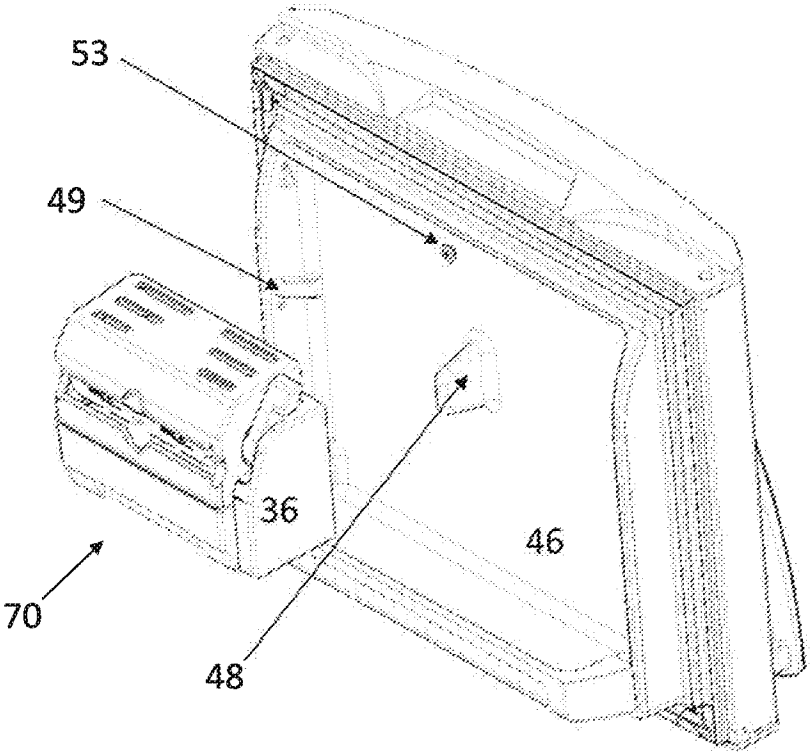
FIG. 12*a* is a conventional perspective view of the door of the freezer with a "liner" with the ice bar making device in an extracted position.

Lastly, as can be seen in FIG. 12*a*, 12*b* the ice bar making device (70) has means which are especially conceived to be able to attach it in a separable fashion to the inner cover (46) or liner of a freezer of a household refrigerator; thereby in the area of the upper back corner of the lateral face of the carcass (10) a cavity is found with a gulf type shape which is here on after called a coupling gulf (47), which itself receives a hook (49) which is protruded over the inner face of the liner (46), the hook (49) has a shape such that it allows for its correct coupling within the coupling gulf (47); this assembly supports the ice bar making device (70) in order to restrict the movement of the ice bar making device (70) in a lateral manner, on one side the referred to ice bar making device (70) is limited by the lateral wall of the liner (46), but the other side is free, unto this, a nipple (48) is placed precisely on a side of the carcass (10) and thus the guard (36) is set with a window such that it allows for the passage of the nipple (48) so that this is able to impede the lateral movement of the ice bar making device (70). Similarly, in an alternative embodiment of the present invention, the back wall of the carcass (10) may be set with a buttonhole, an orifice, a groove or a recession which allows for the housing of a screw or another fastening means (53), this with the view of preventing that the ice bar making device (70) should fall, in case the operator should close the door to the freezer compartment of the refrigerator with much force.

Alterations to the structure described in the present may be able to be foreseen by those persons skilled in the art. However, it should be understood that present description is related with the preferred embodiments of the invention, which is merely for illustrative purposes, and must not be construed as a limitation of the invention. All embodiments which do not depart from the scope of the invention, such as adapting two or more ice bar making trays in the device, adapting additional tanks or divisions within the same, etc. are considered to lie within the scope of the attached claims.

The invention claimed is:

1. A device for making ice bars set within the freezer of a household refrigerator, the device comprising:

a. a carcass with a lateral face, an opposite lateral face, a neck with a "V" shape on a lower part of an inner face of the lateral faces and a guiding throat which tops off with a semi-cylinder Which is in connection with a "C" channel set over the opposite lateral face;

b. a lever set over a runway found on the lateral face of the carcass, wherein said lever is mechanically grasped to a helicoid spring which returns it to a resting position, the lever comprising a disk and a "U" channel set over the disk and a pair of cylindrical concentric walls which form a cavity which houses the helicoid spring;

c. a guard set over the lateral face of the carcass which contains the lever, the guard has an inner face; wherein said guard has a protruded tube in its inner face which is housed within an inner cylindrical wall of the lever;

d. a tray which houses a series of molds for making ice bars, which on its flank sides has set on a central axis portion and a cam follower; and e. a drawer for collecting the ice bars produced and extracted from the tray upon turning it and deforming it, when the user takes the lever from its resting position to the end of the path; and wherein said tray is introduced into the carcass through a groove, opening or window set over the front face of the carcass, wherein the tray central axis portion and the cam follower are introduced into the carcass guiding throat so that at the time the central axis portion be housed within the carcass semi-cylinder and the cam follower run a lower part of the carcass "C" channel; and wherein the central axis portion remains housed in a bottom part of the "U" channel of the lever which allows rotating and deforming said tray.

2. The device according to claim 1, further comprising:

a series of undulations, petals or valleys and crests set over the face of the disk of the lever.

3. The device according to claim 1, further comprising:

a notch set over a periphery of a hole which grants the carcass path its shape on the vertical lateral face of the carcass, through which a hook set on the periphery of the disk of the lever passes freely.

4. The device according to claim 1, further comprising:

a hump or safety latch for the central axis portion of the tray set on the "U" channel of the lever as well as on the periphery of the semi-cylinder set on the vertical lateral face of the carcass.

5. The device according to claim 1, further comprising:

a bulge which follows the shape of a curve or arc segment of a circumference set on the upper horizontal part of the "U" channel.

6. The device according to claim 1, wherein said drawer comprises a pair of horizontal lateral walls, which have on their upper part a pair of fins set respectively on each of the horizontal lateral walls; and wherein the carcass "V" neck houses and grants support to the upper fins of the drawer.

* * * * *